US007069755B2

(12) United States Patent
Lies et al.

(10) Patent No.: US 7,069,755 B2
(45) Date of Patent: Jul. 4, 2006

(54) DEADBOLT LOCK WITH ELECTRONIC TOUCH-KEY

(76) Inventors: William B. Lies, 24 Hamilton Ave., Berkeley Heights, NJ (US) 07922; Richard W. Johns, 2 Crickett La., Chester, NJ (US) 07930; Jun-Fei Zhang, 1 TianHe Road, YongGui Town, ShunDe District, FuShan City, GuangDong (CN) 525306; Jiandong Ke, 327B Crowells Rd., Highland Park, NJ (US) 08904

( * ) Notice: Subject to any disclaimer, the term of this patent is extended or adjusted under 35 U.S.C. 154(b) by 0 days.

(21) Appl. No.: 11/070,330

(22) Filed: Mar. 3, 2005

(65) Prior Publication Data

US 2005/0144994 A1 Jul. 7, 2005

Related U.S. Application Data

(63) Continuation of application No. 10/401,730, filed on Mar. 31, 2003, now abandoned.

(51) Int. Cl.
*E05B 49/02* (2006.01)

(52) U.S. Cl. ..... 70/278.2; 70/472; 70/218

(58) Field of Classification Search ..... 70/278.2, 70/218, 277, 472, 189, 422, 222–223, 278.1, 70/278.7, 283.1
See application file for complete search history.

(56) References Cited

U.S. PATENT DOCUMENTS 4,671,087 A * 6/1987 Olenfalk et al. ..... 70/283
4,736,970 A * 4/1988 McGourty et al. ..... 70/283
4,956,984 A * 9/1990 Chi-Cheng ..... 70/277
5,018,375 A * 5/1991 Tully ..... 70/472
5,823,027 A * 10/1998 Glick et al. ..... 70/278.2
6,286,347 B1 * 9/2001 Frolov ..... 70/472
6,427,505 B1 * 8/2002 Imedio Ocana ..... 70/422
6,807,834 B1 * 10/2004 Tsai ..... 70/472
6,845,642 B1 * 1/2005 Imedio Ocana ..... 70/277
2001/0005998 A1 * 7/2001 Imedio Ocana ..... 70/277

* cited by examiner

*Primary Examiner*—Brian E. Glessner
*Assistant Examiner*—Christopher Boswell
(74) *Attorney, Agent, or Firm*—Jacobs & Kim LLP; Daniel Kim, Esq.

(57) ABSTRACT

A deadbolt lock has a housing and a deadbolt latch mounted to the housing. The deadbolt latch has a bolt that is moveable between an extended, locked position, and a retracted, unlocked position. An outside thumb-turn rotatably mounted to the housing. A motor-driven axial clutch is connected between the deadbolt latch and the outside thumb-turn. The bolt is movable by the thumb-turn only when the clutch is engaged. A microcomputer disposed within the housing. An electric motor is connected between the microcomputer and the clutch for engaging and disengaging the clutch. An electronic touch-key reader is disposed in the housing. The electronic touch-key reader is electronically connected to the microcomputer and is capable of reading a digital security code from an electronic touch-key applied thereto. The microprocessor actuates the electric motor to engage the clutch only when an authorized digital security code is read by the electronic touch-key reader.

15 Claims, 8 Drawing Sheets

DEADBOLT LOCK WITH ELECTRONIC TOUCH-KEY

CROSS-REFERENCE TO RELATED APPLICATIONS

This application is a continuation of U.S. patent application Ser. No. 10/401,730, filed on Mar. 31, 2003 now abandoned, which is incorporated herein by reference in its entirety.

BACKGROUND OF THE INVENTION

1. Field of the Invention

The present invention relates to a deadbolt lock with an electronic touch-key, and particularly to a deadbolt lock having an electronic touch-key containing a microcomputer chip that exchanges a security code with a microcomputer contained within the deadbolt lock housing to unlock the deadbolt.

2. Description of the Related Art

Deadbolt locks are commonly and widely used in residential homes, apartments, commercial buildings, and other settings where it is desired to secure an entry against unwanted intrusion. Deadbolt locks are used in some instances as the sole means to lock an entry door, and in other instances in conjunction with other locking mechanisms. Traditional deadbolt locks employ a mechanism that includes a set of internal tumblers that must engage with the teeth formed in a conventional key to open the lock. A key that relies on the mechanical interaction of its shape with the tumblers of a lock can be readily copied. The security provided by conventional locks can be jeopardized when duplicate keys, that might be maintained by an apartment or rental building manager or retained by a dwelling's previous owner, exist and can be copied. Additionally, a person with a locksmith's skills may be able to "read" the tumblers of a lock with a set of locksmith's tools and create a suitable key without even the need for an original key to copy.

As owners and tenants of a dwelling come and go, it is often necessary and desirable to change the locks to ensure that old keys that may be retained by old occupants are no longer functional. In residential homes, this task is an inconvenience. In apartment complexes, where there may be a large turnover in occupants, this may become costly. For a hotel, this cost is prohibitive. In any environment where a building manager or maintenance team has a set of duplicate keys or a master key even the safeguard of changing locks cannot entirely eliminate the security threat of duplicate keys.

Electronically keyed locks have been employed to solve these problems. Electronic locks have incorporated card readers, keypads, remote control devices, and other methods to achieve greater security and flexibility in re-keying. Among the electronic devices that have been used to activate door locks are electronic touch-keys, which are typically devices wherein a microcomputer chip is housed within a case and is activated on contact with a reader. A deadbolt lock using an electronic touch-key, that would provide enhanced security and solve problems inherent with duplicate keys and re-keying expense and effort, presents particular challenges of power consumption, size, and complexity. In battery-powered solutions battery life plays a significant role, and when excessive power is used the device will require excessive maintenance to replace the batteries. Some electronic lock assemblies are simply too large to allow a quick retrofit by simply replacing a conventional lock with the new device. Numerous efforts to produce an electronically keyed door lock have been handicapped by such shortcomings.

The U.S. Patent Publication No. 2001/0028299, published October, 2001, discloses an electronic key assembly working in conjunction with a deadbolt lock. The electronic key disclosed is a touch-key device incorporated into a housing having the general shape and form of a conventional key. A small computer chip is enclosed in the head of the key assembly. A data contact protrudes from the front of the key head so that, when the key blade is inserted into the lock, the data contact engages with a matching data contact on the lock adjacent to the key slot. The computer chip exchanges a security code with a microprocessor contained within the lock and, when a valid security code is received, the microprocessor commands a solenoid mechanism to unlock the lock. The solenoid plunger, or a plate that is operated by the solenoid plunger, is engaged to or disengaged from the lock cylinder plug to prevent or allow rotation of the cylinder plug. When the plunger or plate is disengaged from the cylinder plug, thereby allowing its rotation, the mechanism is unlocked. A weakness of this arrangement is that, because the mechanism is unlocked when the solenoid is energized, there is a continuous current drain while the lock is maintained in its unlocked state. Thus, the life of batteries used for power cannot be maximized. Additionally, because the lock relies on the plunger or plate to physically engage with the cylinder to prevent rotation, application of excessive turning force while the lock is locked could damage the lock or overcome the locking mechanism and allow unauthorized entry.

The U.S. Pat. No. 5,437,174, issued on Aug. 1, 1995 to K. Aydin, discloses another electronic lock system that uses an electronic touch-key to activate a locking/unlocking mechanism. The locking/unlocking mechanism, activated into the unlocked position by the exchange of a security code between the electronics key and an internal microprocessor circuit, uses an electric motor to cause a plunger to engage with or disengage from a cavity in the lock cylinder. This arrangement allows the lock to remain in either the locked or unlocked state without continued current drain from the batteries. However, the motor assembly is rather bulky and requires that a door be modified to accommodate the lock assembly. Rather than fitting a single round hole typically required to accommodate a door lock assembly, an additional hole must be drilled through the door to accommodate the motor assembly. This increases the cost and complexity of the lock's installation, and eliminates the possibility that the electronic lock can be easily retrofitted in place of an existing door lock without further modification of the door.

U.S. Pat. No. 5,923,264, issued on Jul. 13, 1999, to G. E. Lavelle et al., shows an electronic lock system that incorporates an electronic touch-key along with alternate access code readers. Such an alternate access code reader might be a keypad where an access code could be manually entered. The lock is responsive to any of its access code readers. The lock assembly as shown includes a combined keypad and touch-key reader panel that is entirely separate from the door lock and handle mechanism itself. Further, a second separate housing is required for the electronic circuitry. The keypad and touch-key reader panel is shown on the opposite side of the door from the electronics housing, requiring an extra hole to be drilled through the door to allow for the electrical connections necessary between components. This lock fails to provide for an easy retrofit by simply replacing a door's existing lock.

The Chinese patent CN2441930 of Zhang, one of the co-inventors of the present invention, published on Aug. 8, 2001, describes an axial clutch mechanism.

None of the above inventions and patents, taken either singularly or in combination, is seen to describe the instant invention as claimed. Thus a deadbolt lock with an electronic touch-key solving the aforementioned problems is desired.

SUMMARY OF THE INVENTION

The deadbolt lock with electronic touch-key is a deadbolt lock that may be unlocked for passage by using an electronic touch-key. The electronic touch-key is a device that contains a small microcomputer chip. In use, the microcomputer chip within the touch-key communicates with a microcomputer inside the lock housing when the touch-key is contacted to a reader on the lock housing. When the microcomputer inside the lock housing determines that a valid and authorized touch-key is in contact with the reader, the microcomputer inside the lock housing generates a signal to allow the lock to be opened.

The deadbolt is a standard type of deadbolt that is operated by turning a shaft or a hub to extend and retract the bolt. As in typical deadbolt lock installations, for example in an entry door, a thumb-turn on the inside of the door allows the bolt to be extended and retracted, locking and unlocking the door, in a conventional manner. A thumb-turn on the outside of the door allows for operation of the lock only when a valid touch-key has been applied.

A motor driven axial clutch, contained within the lock housing, serves to engage the outside thumb-turn with, and disengage the outside thumb-turn from, the deadbolt hub. Thus, to operate the lock from the outside a touch-key is applied to the touch-key reader causing the motor driven axial clutch to be driven into it's engaged position, allowing operation of the deadbolt from the outside thumb-turn. Because the outside thumb-turn is completely disengaged from the deadbolt hub except when an authorized touch-key is applied, excessive force cannot be used to damage the lock or to gain unauthorized entry.

Because the motor is only activated for a short duration to move the clutch into its engaged or disengaged position, and because only a small motor is needed to operate the clutch, a significant savings in battery life is obtained in comparison to locks that are solenoid operated or locks where the motor is used to move a door handle or the deadbolt itself.

Accordingly, it is a principal object of the invention to provide a deadbolt lock with an electronic touch-key.

It is another object of the invention to provide a deadbolt lock with an electronic touch-key that can easily replace an existing conventional deadbolt lock.

It is a further object of the invention to provide a deadbolt lock with an electronic touch-key that can be programmed to activate and deactivate user and master keys without the need for an external computer or programming device.

Still another object of the invention is to provide a deadbolt lock with an electronic touch-key that utilizes a motor driven axial clutch to physically disengage an outside thumb-turn from the deadbolt to prevent the operation of the deadbolt by the outside thumb-turn.

It is an object of the invention to provide improved elements and arrangements thereof for the purposes described which is a inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
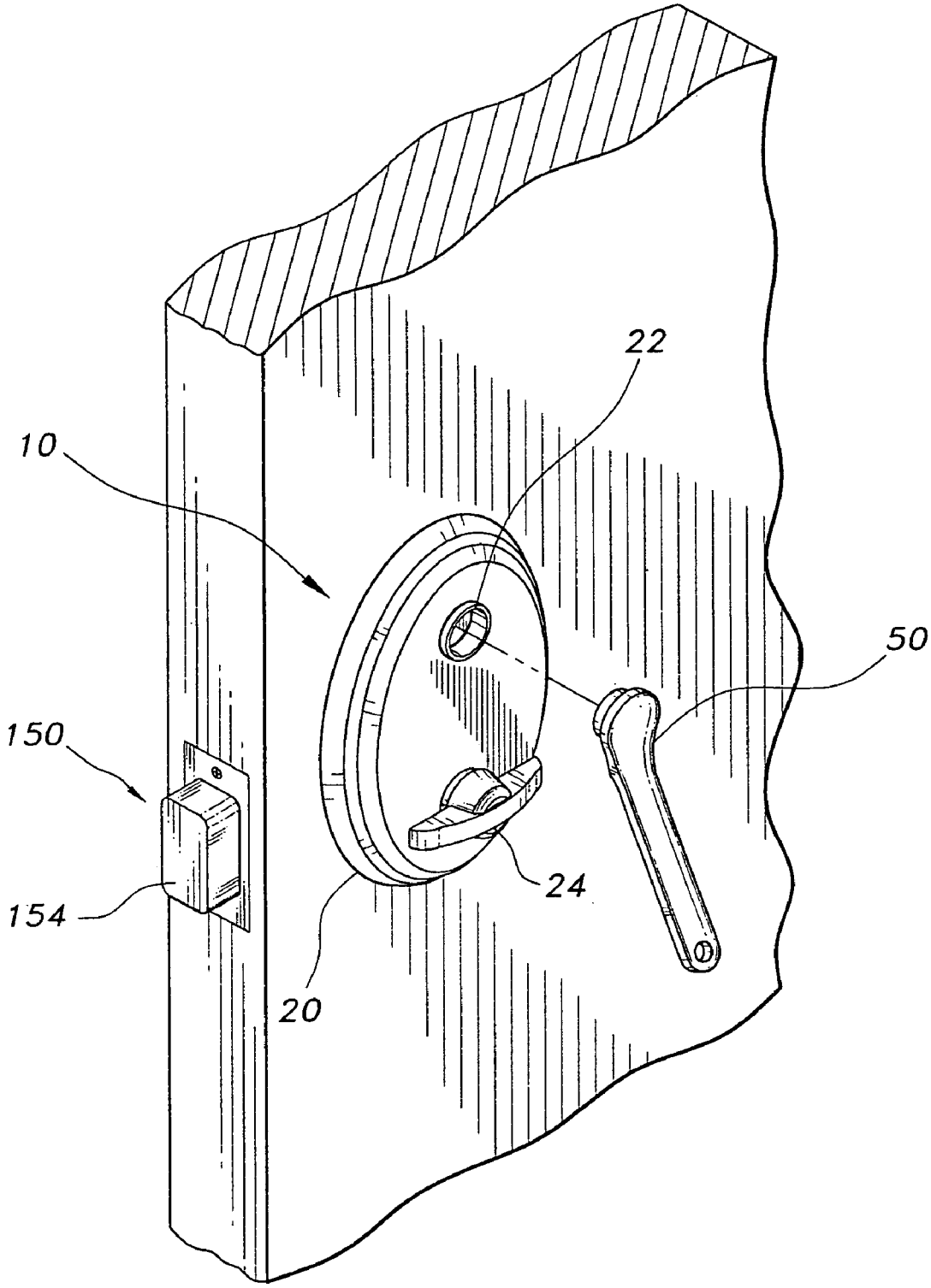
FIG. 1 is an environmental, perspective view of a deadbolt lock with an electronic touch-key according to the present invention.
Figure 2:
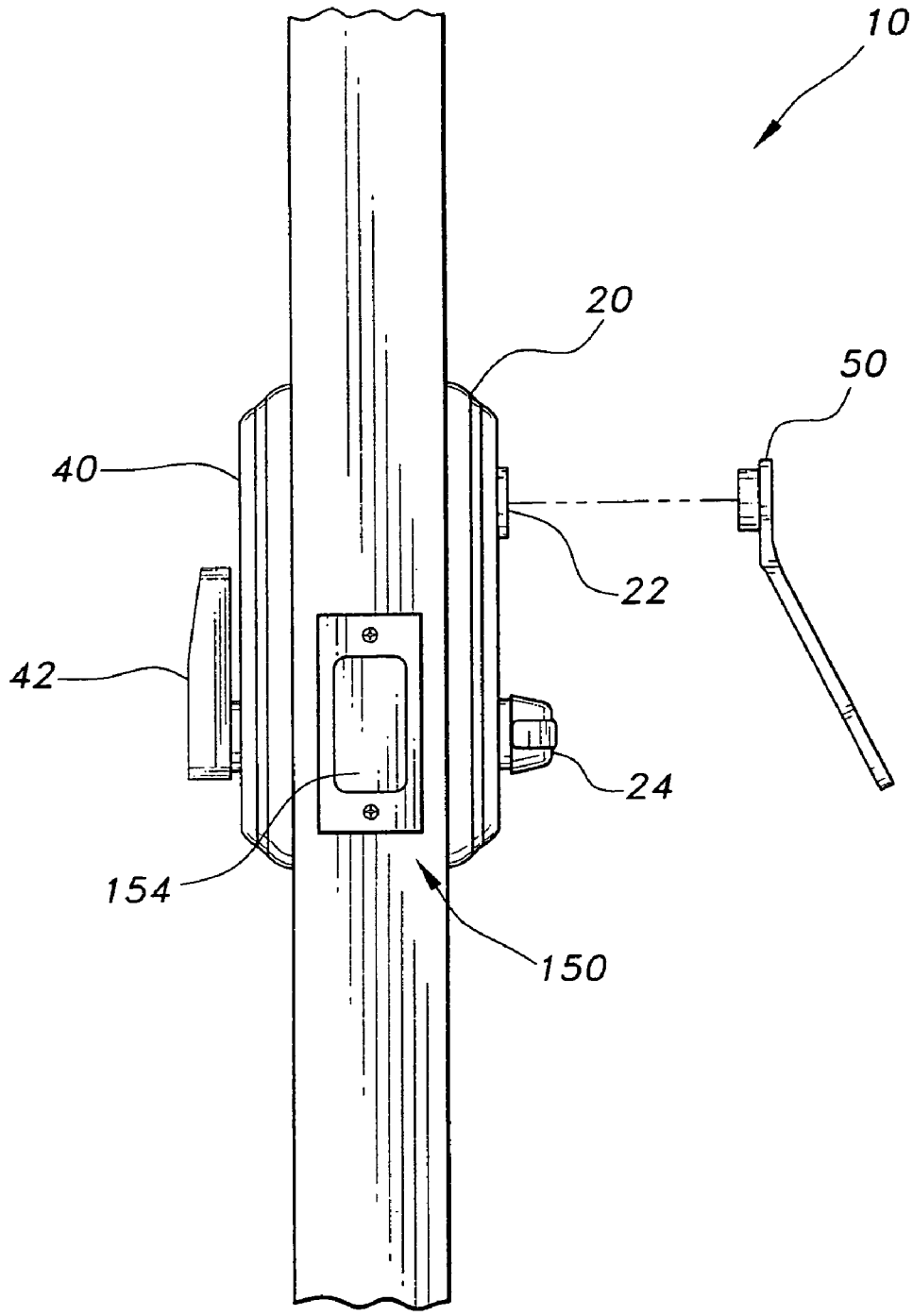
FIG. 2 is a side elevational view of the lock as installed in a door.
Figure 3:
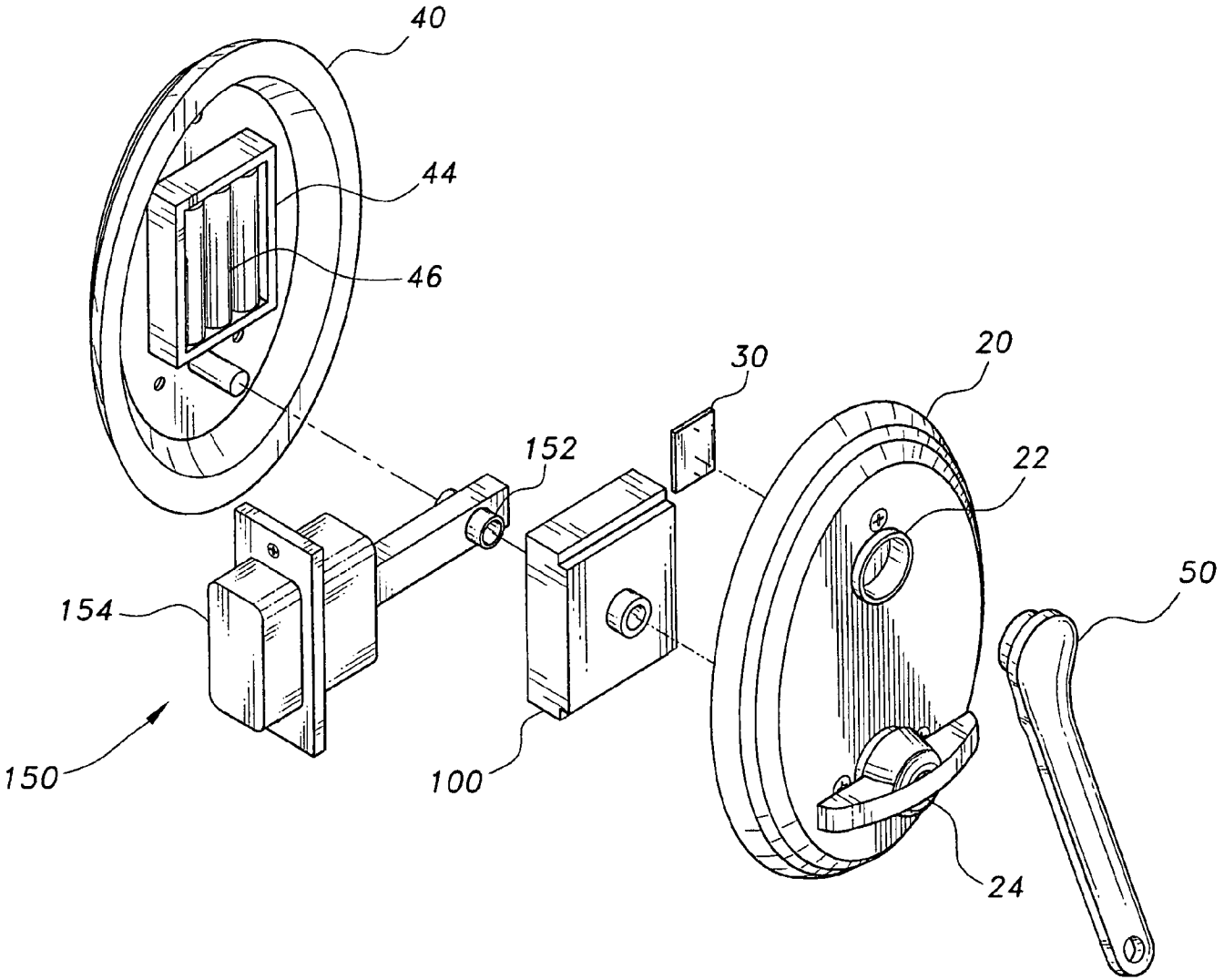
FIG. 3 is an exploded perspective view of the lock showing the relationship of its key components.

The present invention is a deadbolt lock with an electronic touch key, designated generally as 10 in the drawings. The deadbolt lock with an electronic touch key 10, shown generally in FIG. 1-2, is an electronically operated locking mechanism that includes a conventional deadbolt latch 150 having a bolt 154 that can be extended and retracted. The deadbolt latch 150 may be operated in a conventional manner from an interior side of the door installation, by turning an inside thumb-turn 42. From the outside, an outside thumb-turn 24 can operate the deadbolt latch 150 when an authorized electronic touch-key 50 is applied to an electronic touch-key reader 22. The electronic touch-key 50 is preferably an iButton® electronic touch-key device manufactured by Dallas Semiconductor Co. in Dallas, Tex. Turning to FIG. 3, it can be seen that a motor driven axial clutch 100 is disposed between the outside thumb-turn 24 and a deadbolt hub 152. The deadbolt hub 152 can be rotated to extend or retract the bolt 154, in a manner that is well known. The motor driven axial clutch 100 functions to engage the outside thumb-turn 24 with, or disengage the outside thumb-turn 24 from, the deadbolt hub 152. When the motor driven axial clutch 100 engages the outside thumb-turn 24 with the deadbolt hub 152, the outside thumb-turn 24 may be turned to move the bolt 154 from its extended position to its retracted position, or from its retracted position to its extended position. When the motor driven axial clutch 100 disengages the outside thumb-turn 24 from the deadbolt hub 152, the deadbolt latch 150 cannot be operated by the outside thumb-turn.

Figure 5:
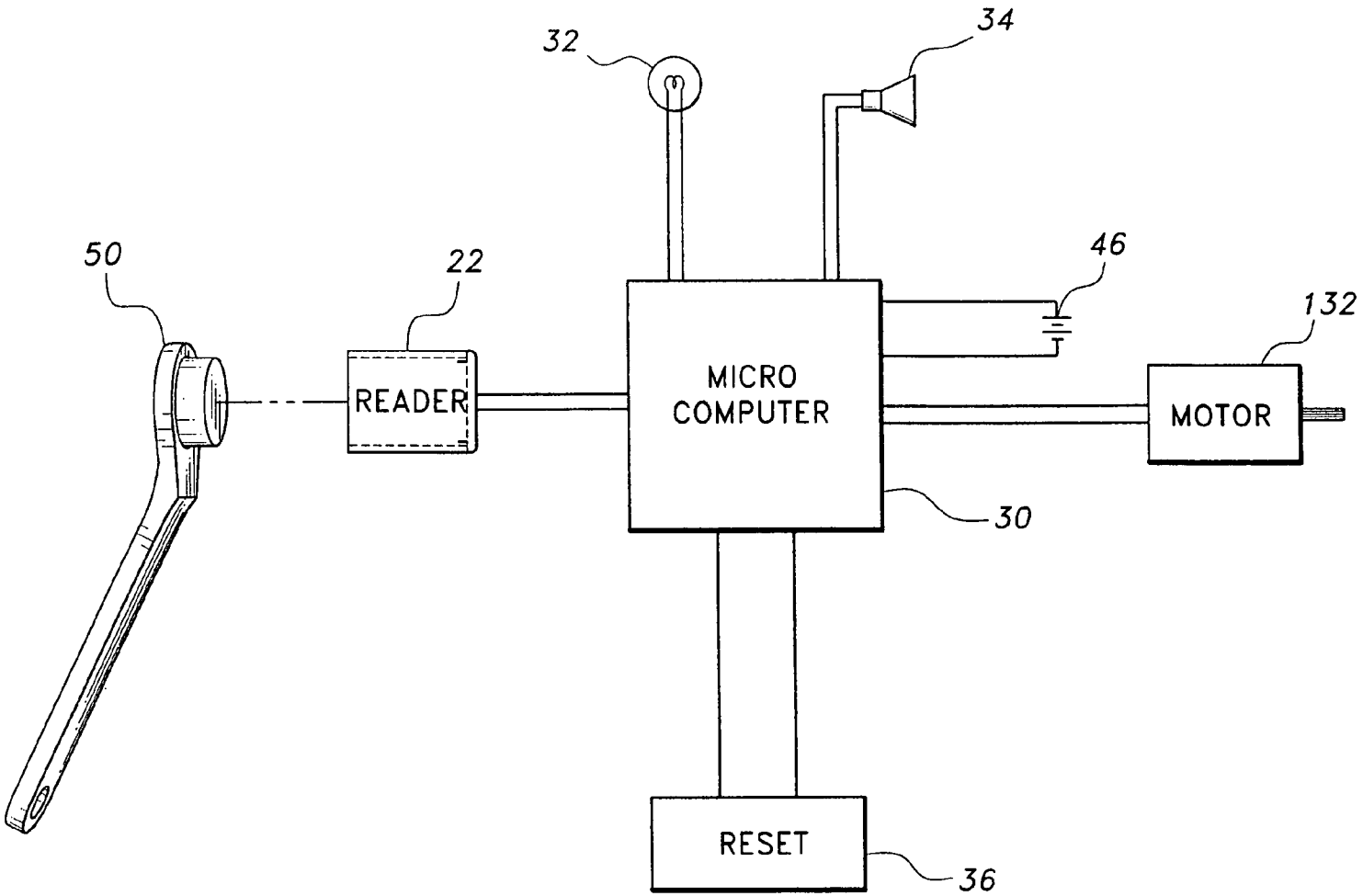
FIG. 5 is a block diagram showing the microcomputer and its connection to its related components.

The motor driven axial clutch 100 is contained within an outside housing 20. A microcomputer 30 is also contained within the outside housing. As seen in FIG. 5, the microcomputer is in electrical connection with the electronic touch-key reader 22 and with the motor driven axial clutch 100. Additionally, the microcomputer is in electrical connection with a light-emitting signal 32, such as an LED, and with an audible signal 34 such as an electronic beeper. A pushbutton 36 is provided to reset the microcomputer. The microcomputer is one of a type well known in the art that contains a memory and program storage means.

A microcomputer program code is stored in the microcomputer 100. The microcomputer 100 controls the operation of the lock, allows for management of keys to be used with the lock, and generates light and audible signals to indicate various operational status's to a user during operation. The microcomputer program code is responsive to the electronic touch-key reader 22 to read a security code form the electronic touch-key 50. The microcomputer program code compares the security code read from the electronic touch-key 50 with an internally maintained list of authorized security codes. When a security code is read that is authorized for entry, the microcomputer program code causes the microcomputer 30 to signal the motor driven axial clutch to engage the outside thumb-turn 24 with the deadbolt hub 152. At a short interval after the authorized electronic touch-key 50 is removed from the electronic touch-key reader 22, the microcomputer program code causes the microcomputer 30 to signal the motor driven axial clutch to disengage the outside thumb-turn 24 from the deadbolt hub 152.

Additionally, the microcomputer program code allows for management of the touch-keys that may be used with the deadbolt lock with electronic touch key 100 ("the lock").

The lock 100 may be configured to recognize an electronic touch-key 50 as a master key. To activate a master key, the microcomputer 30 must be reset. Pressing the reset button 36 will reset the microcomputer 30. The lock 100 emits a signal to indicate that an electronic touch-key 50 may now be read and activated as the master key. Applying a touch-key to the reader at this point will cause the touch-key security code to be recorded and activated as the master key. After a short time-out interval, the lock 100 will return to its normal operating mode.

Once a master key has been designated, a number of user keys may be configured. To activate user keys, the master key is touched to the reader 22 and held until the lock 100 emits a signal to indicate that the lock 100 is in a mode to read and activate user keys. While the lock 100 remains in this mode, each key subsequently touched to the reader 22 is added to the internally maintained list of active user keys. After a short time-out interval, the lock 100 will return to its normal operating mode. To deactivate active user keys, the master key is touched to the reader 22 and held until the lock 100 emits a signal to indicate that the lock 100 is in a mode to deactivate user keys. While the lock 100 remains in this mode, each key subsequently touched to the reader is removed from the list of authorized user keys. After a short time-out interval, the lock 100 will return to its normal operating mode.

Figure 4A:
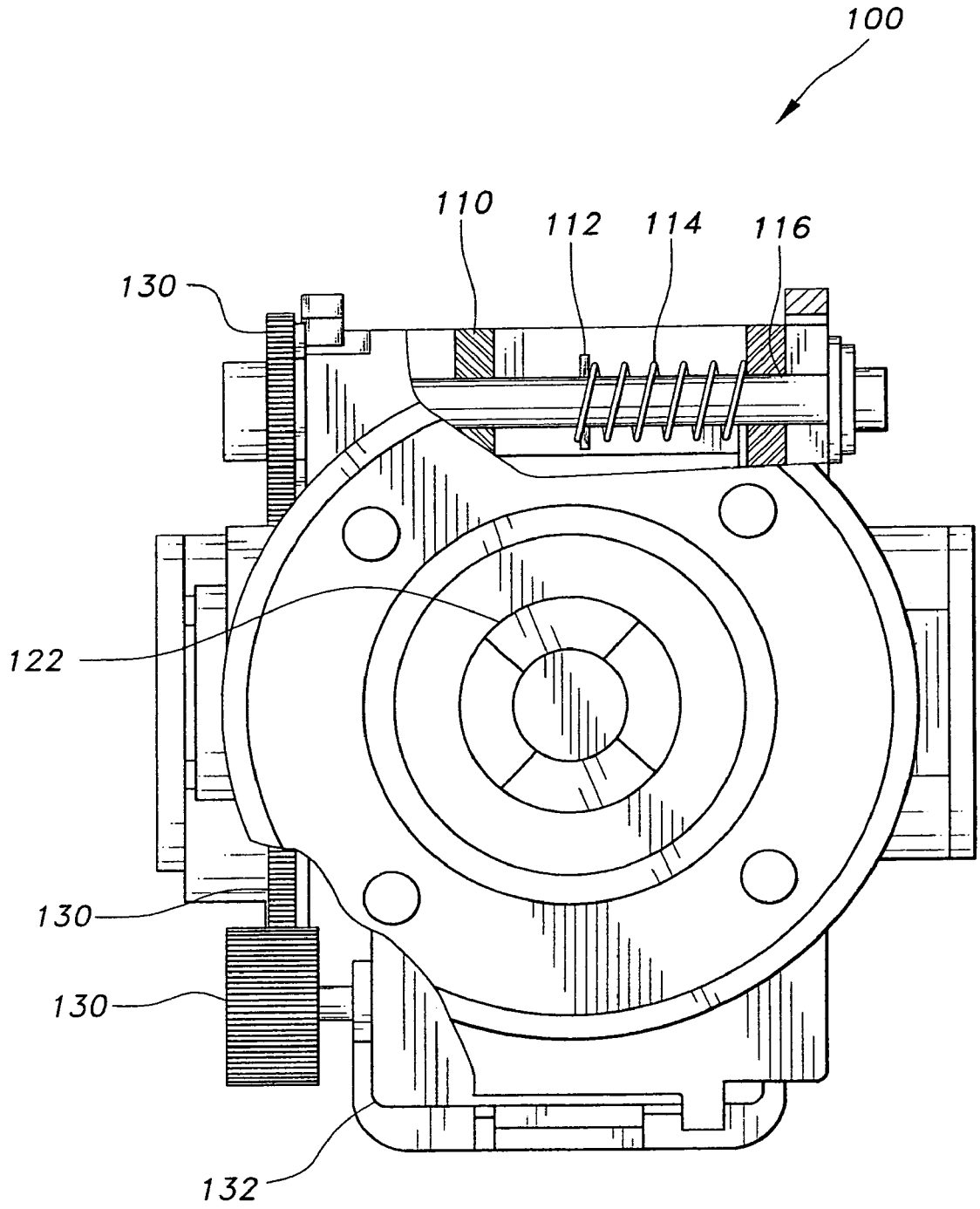
FIG. 4A is an elevational view of the motor driven axial clutch assembly with a cutaway view of an internal transmission axle and related components, and a partial cutaway showing the motor.
Figure 4B:
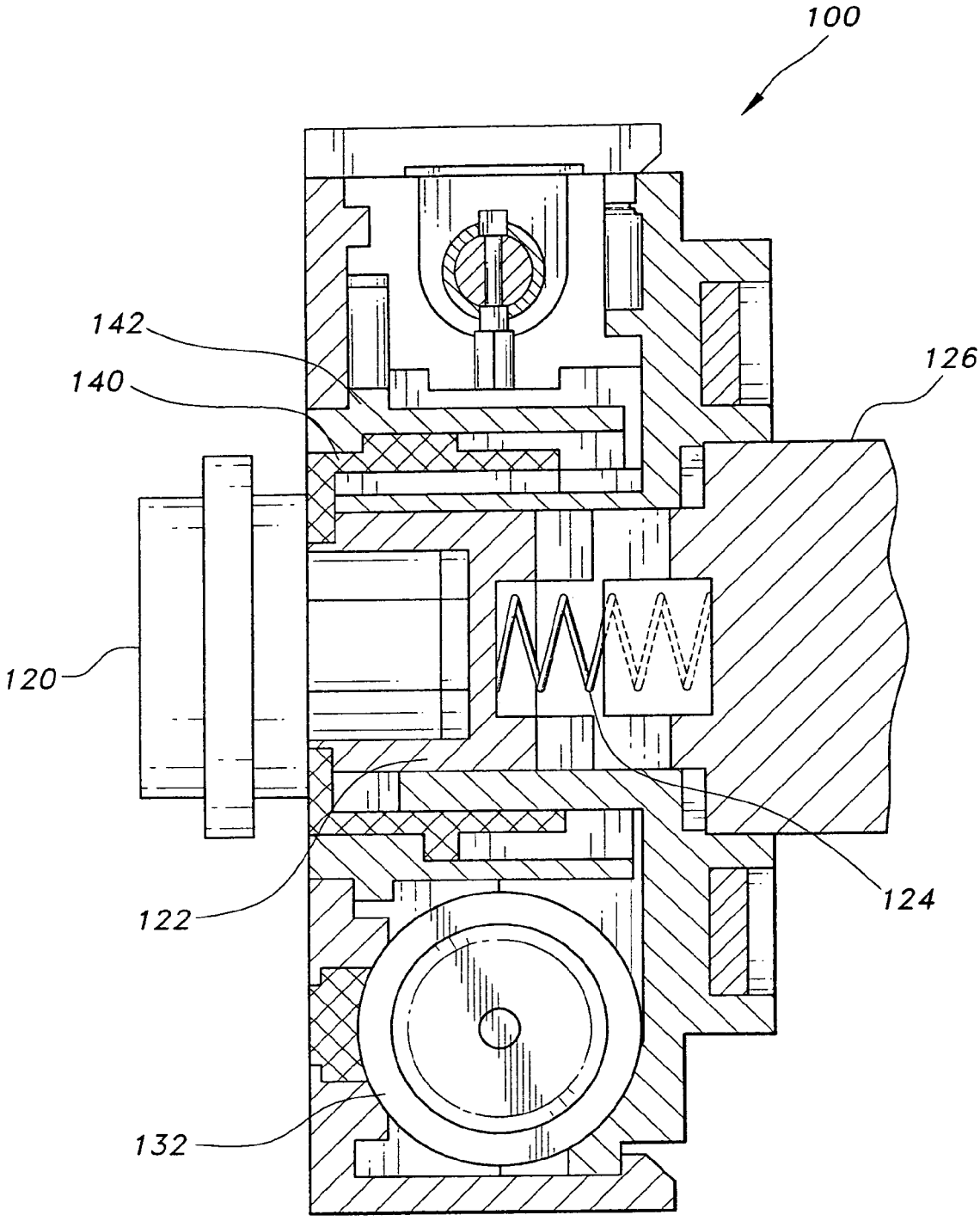
FIG. 4B is a cross-section view of the motor driven axial clutch.

Turning now to FIGS. 4A and 4B, the motor driven axial clutch 100 functions to engage an outside thumb-turn shaft 126 to, and disengage the outside thumb-turn 24 from, a deadbolt shaft sleeve 120. The deadbolt shaft sleeve 120 connects to the deadbolt hub 152, and the outside thumb-turn shaft 126 connects with the outside thumb-turn 24.

The deadbolt shaft sleeve 120 is axially aligned with the outside thumb-turn shaft 126. A clutch collar 122 is slidably disposed on the deadbolt shaft sleeve 120. The clutch collar 122 can be extended to engage with the outside thumb-turn shaft 126, or retracted to disengage from the outside thumb-turn shaft 126. Engaging the clutch collar with the outside thumb-turn shaft 126 allows the outside thumb-turn shaft 126 to operate the deadbolt latch 150. The clutch collar is spring biased to its retracted, disengaged position. Disengaging the clutch collar from the outside thumb-turn shaft 126 prevents the outside thumb-turn shaft 126 from operating the deadbolt latch 150.

The deadbolt shaft sleeve 120, clutch collar 122, and outside thumb-turn shaft 126 form the core of the motor driven axial clutch 100. A bi-directional electric motor 132, a train of gears 130, and a transmission axle 116 are disposed generally around the deadbolt shaft sleeve 120, the clutch collar 122, and outside thumb-turn shaft 126. The motor 132 is connected to the transmission axle 116 by the gears 130. A helix 114 is disposed around the transmission axle 116. A cotter 112 is disposed through the transmission axle 116, and engages with the helix 114 so that the helix 114 is moved along the transmission axle 116 by the rotation of the cotter 112. A slide piece 110 is slidably disposed on the transmission axle with the helix 114 between ends of the slide piece 110 so that the slide piece is moved along the transmission axle 116 by the helix 114. As the slide piece 110 moves along the transmission axle 116, the slide piece moves a slidable cam 142. The slidable cam moves a cam follower 140. The cam follower 140 in turn moves the clutch collar. Thus, a rotation of the motor 132 causes a movement of the clutch collar 142 to its extended and engaged position, while a counter rotation of the motor allows the spring 124 to return the clutch collar 142 to its retracted and disengaged position.

Figure 6A:
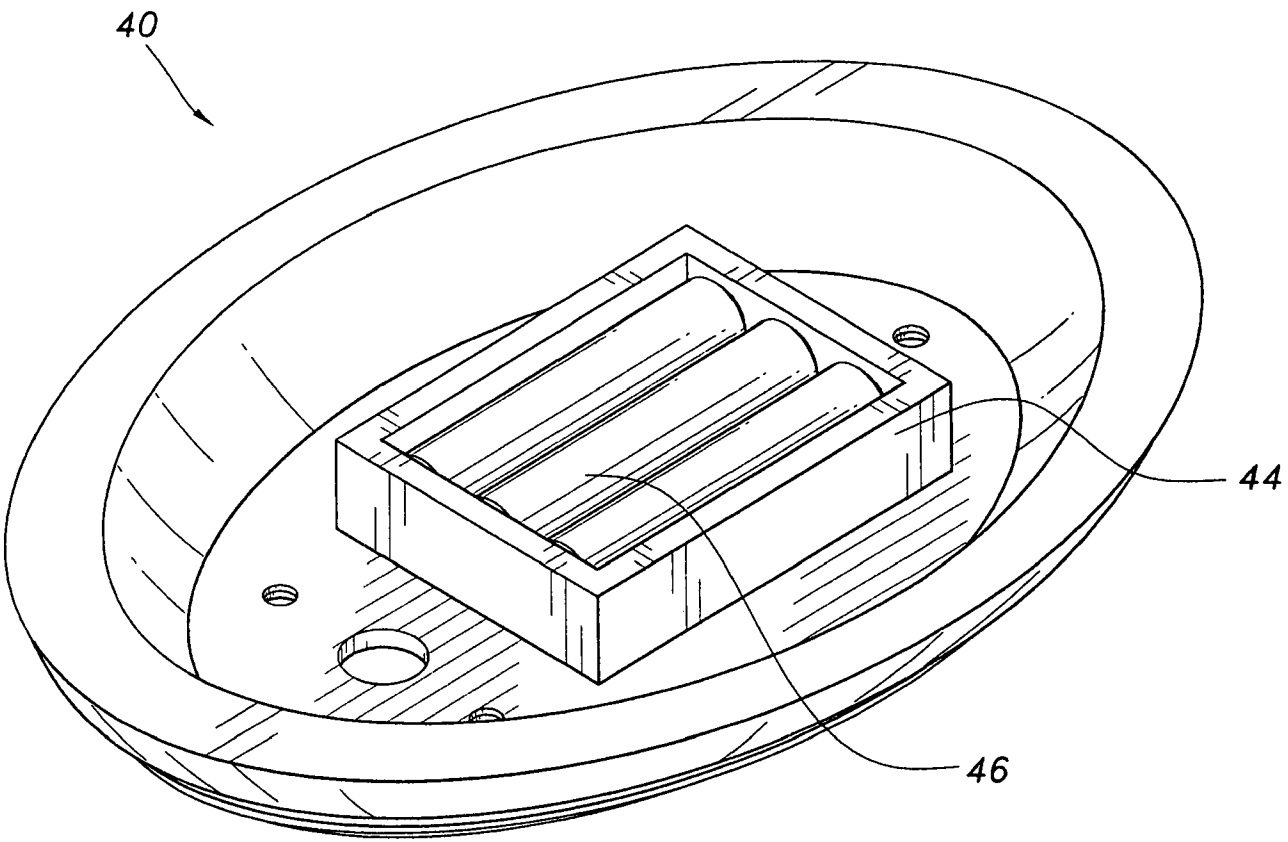
FIG. 6A is a perspective view of the inside of the inside housing showing a battery holder and batteries.
Figure 6B:
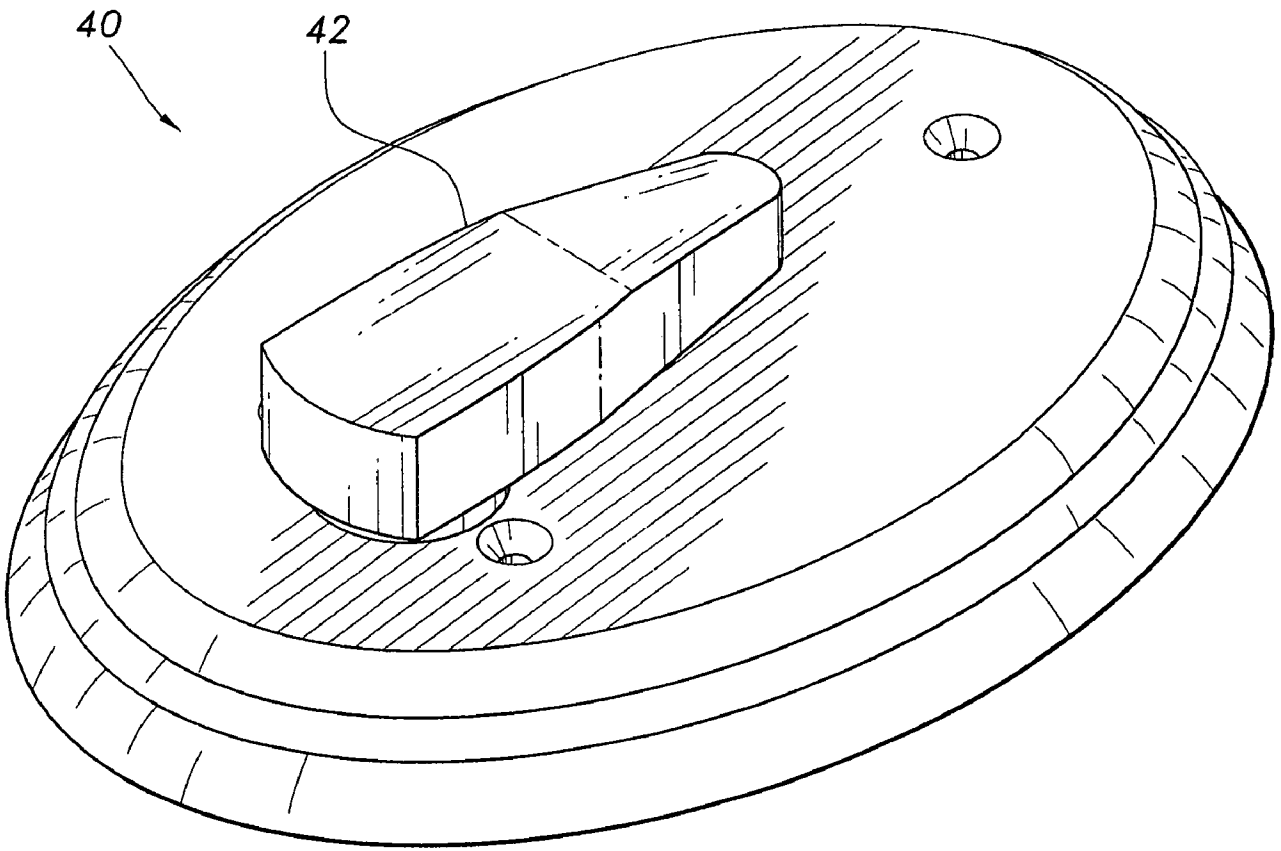
FIG. 6B is a perspective view of the outside of the inside housing showing a thumb-turn.

The deadbolt lock with electronic touch-key 10 includes an inside housing 44, shown in FIGS. 6A and 6B, which contains batteries 46, disposed in a battery holder 44. An inside thumb-turn 42 is disposed on the inside housing and is in connection with the deadbolt hub 152.

It is to be understood that the present invention is not limited to the embodiment described above, but encompasses any and all embodiments within the scope of the following claims.

We claim:

1. A deadbolt lock, comprising:

a housing;

a deadbolt latch mounted to the housing, the deadbolt latch having a bolt that is moveable between an extended, locked position, and a retracted, unlocked position, the deadbolt latch further including a deadbolt hub that is turned to move the bolt between its extended and refracted positions;

an outside thumb-turn rotatably mounted to the housing;

a clutch, having a core comprising a deadbolt shaft sleeve connected to the deadbolt hub;

an outside thumb-turn shaft connected to the outside thumb-mm, and a clutch collar, slidably mounted onto the deadbolt shaft sleeve, the clutch collar being slidable between an engaged position, in which the deadbolt shaft sleeve and the outside thumb-turn shaft rotate as a unit to turn the deadbolt hub, and a disengaged position, in which the outside thumb-turn shaft rotates separately from the deadbolt shaft sleeve, the clutch further comprising an electric motor mounted along a first side of the clutch core, and a transmission axle mounted along a second side of the clutch core diametrically opposite the first side, the electric motor and the transmission axle being positioned such that the clutch core is positioned between the transmission axle and the electric motor, and such that the transmission axle is parallel to the electric motor shaft, the electric motor shaft and the transmission axle being coupled to each other by a gear train, the gear train extending along a third side of the clutch core, such that the clutch core is enclosed on three sides by the electric motor shaft, the gear train, and the transmission axle; and a cam movably mounted between the transmission axle and the clutch collar, such that rotation of the transmission axle causes the cam to move between a first position and a second position, the movement of the cam from its first position to its second position causing the clutch collar to move into its engaged position;

a microcomputer disposed within the housing, the microcomputer being connected to the electric motor; and an electronic touch-key reader disposed in the housing, the electronic touch-key reader being electronically connected to the microcomputer and being capable of reading a digital security code from an electronic touch-key applied thereto, the microprocessor actuating the electric motor to engage the clutch only when an authorized digital security code is read by the electronic touch-key reader.

2. The deadbolt lock of claim 1, wherein the microprocessor includes a central processing unit and a memory, and wherein the deadbolt lock further comprises:

a list of authorized user codes stored in the memory; and a computer readable program code stored in the memory, the program code having means for reading a security code from a touch-key applied to the touch-key reader, means for comparing the security code to the list of authorized user codes, and means for producing a control signal for actuating the electric motor to engage the clutch when an authorized user code is read by the touch-key reader.

3. The deadbolt lock of claim 2, wherein the program code further comprises means for designating a security code as a master key security code.

4. The deadbolt lock of claim 2, wherein the program code further includes means for adding and deleting touch-key security codes from the list of authorized user codes.

5. The deadbolt lock of claim 1, further including means for audibly indicating a status.

6. The deadbolt lock of claim 1, further including means for visually indicating a status.

7. The deadbolt lock of claim 1, further including a reset button disposed within the housing, the reset button being electrically connected to the microcomputer.

8. The deadbolt lock of claim 1, wherein the clutch collar is spring-biased to its retracted, disengaged position.

9. The deadbolt lock of claim 1, wherein the electric motor is bi-directional, and wherein the deadbolt lock further includes:

a helix disposed around the transmission axle;

a cotter disposed through the transmission axle and engaging with the helix such that the helix is movable along the transmission axle by rotation of the cotter;

a slide piece slidably disposed on the transmission axle, the helix being positioned between first and second ends of the slide piece, such that the slide piece is movable along the transmission axle by the helix, the cam being connected to the slide piece; and a cam follower connected between the cam and the clutch collar.

10. The deadbolt lock of claim 1, wherein the electric motor is disposed under the deadbolt shaft sleeve, the gear train is disposed at one side of the deadbolt shaft sleeve, and the transmission axle is disposed over the deadbolt shaft sleeve.

11. The deadbolt lock of claim 1, further including:

an inside housing; and an inside thumb-turn disposed on the inside housing, the inside thumb-turn being connected directly to the deadbolt hub.

12. The deadbolt lock of claim 1, further including:

a battery holder for holding batteries to provide power to the electric motor.

13. The deadbolt lock of claim 12, wherein the batteries also provide power to the microprocessor.

14. The deadbolt lock of claim 1, wherein the gear train is perpendicular to the electric motor shaft and to the transmission axle.

15. The deadbolt lock of claim 1, wherein the housing includes an inside housing that is mountable onto a door's interior surface and an outside housing that is mountable onto a door's exterior surface, and wherein the clutch and microcomputer are positioned between the inside housing and the outside housing.

* * * * *